US012808099B2

(12) United States Patent
Matsumoto

(10) Patent No.: US 12,808,099 B2
(45) Date of Patent: Nov. 24, 2026

(54) FABRIC

(71) Applicant: SANKICONSYS CO., LTD., Tokyo (JP)

(72) Inventor: Masahide Matsumoto, Tokyo (JP)

(73) Assignee: SANKICONSYS CO., LTD., Tokyo (JP)

( * ) Notice: Subject to any disclaimer, the term of this patent is extended or adjusted under 35 U.S.C. 154(b) by 0 days.

(21) Appl. No.: 18/284,387

(22) PCT Filed: Mar. 30, 2022

(86) PCT No.: PCT/JP2022/016032
§ 371 (c)(1),
(2) Date: Sep. 27, 2023

(87) PCT Pub. No.: WO2022/210891
PCT Pub. Date: Oct. 6, 2022

(65) Prior Publication Data

US 2024/0158963 A1 May 16, 2024

(30) Foreign Application Priority Data

Mar. 30, 2021 (JP) ..... 2021-058676

(51) Int. Cl.
*D04B 21/20* (2006.01)

(52) U.S. Cl.
CPC ..... *D04B 21/202* (2013.01); *D10B 2401/022* (2013.01); *D10B 2401/10* (2013.01)

(58) Field of Classification Search
CPC ..... D04B 21/14; D04B 21/202; D04B 21/20; D10B 2401/10; A41D 13/0053; A41D 13/0056
See application file for complete search history.

(56) References Cited

U.S. PATENT DOCUMENTS 4,725,487 A 2/1988 Pemrick et al.
6,341,504 B1 1/2002 Istook
(Continued)

FOREIGN PATENT DOCUMENTS

CN 104337003 A 2/2015
EP 0450068 A1 * 10/1991 ..... B01D 63/0231
(Continued)

OTHER PUBLICATIONS

PCT/ISA/210, "International Search Report for PCT International Application No. PCT/JP2022/016032," Jun. 14, 2022.

*Primary Examiner* — Aiying Zhao
(74) *Attorney, Agent, or Firm* — HAUPTMAN HAM, LLP

(57) ABSTRACT

A fabric having a knitted material into which a hollow fiber membrane is knitted is provided, and which provides a configuration in which a liquid flows inside the hollow fiber membrane. Also, the fabric provides a configuration that prevents a needle from penetrating into the hollow fiber membrane when the fabric having the knitted material into which the hollow fiber membrane is knitted is sewn on an article of clothing or when the fabrics each having the knitted material into which the hollow fiber membrane is knitted is sewn to produce an article of clothing. Problems are solved in such a way that a hollow fiber membrane, serving as an insertion thread, is knitted into a knitted material. Also, problems are solved in such a way that a pump is provided for supplying the liquid to the hollow fiber membrane in which the pump is manually operated.

8 Claims, 9 Drawing Sheets

(56) References Cited

U.S. PATENT DOCUMENTS

| | | | | |
|---|---|---|---|---|
| 2003/0068353 | A1* | 4/2003 | Chen | A61L 9/04 424/59 |
| 2004/0229343 | A1* | 11/2004 | Husain | C02F 3/1273 210/615 |
| 2016/0096127 | A1* | 4/2016 | McClary | B01D 69/105 210/490 |
| 2017/0172227 | A1* | 6/2017 | Fan | A41D 13/0025 |
| 2020/0178621 | A1* | 6/2020 | Kittaka | A61F 7/00 |
| 2020/0375316 | A1* | 12/2020 | Dealey | A43B 23/047 |

FOREIGN PATENT DOCUMENTS

| | | | | |
|---|---|---|---|---|
| JP | S48-14062 | Y1 | | 4/1973 |
| JP | S50-037787 | B2 | | 12/1975 |
| JP | S54-101976 | A | | 8/1979 |
| JP | S57-205556 | A | | 12/1982 |
| JP | S61-027085 | A | | 2/1986 |
| JP | S62-231059 | A | | 10/1987 |
| JP | H07-060075 | A | | 3/1995 |
| JP | 2003-041463 | A | | 2/2003 |
| JP | 2008-302906 | A | | 12/2008 |
| JP | 2009-235583 | A | | 10/2009 |
| JP | 2011-127237 | A | | 6/2011 |
| JP | 2013039535 | A | * | 2/2013 |
| JP | 2016-092009 | A | | 5/2016 |
| JP | 6284090 | B1 | | 2/2018 |
| JP | 2018111902 | A | * | 7/2018 |
| JP | 2020-204131 | A | | 12/2020 |

* cited by examiner

| | 1 | 2 | 3 | 4 | 5 | 6 |
|---|---|---|---|---|---|---|
| o | | | | | ■ | |
| n | | | | | | |
| m | | | | | | |
| l | | | | | | |
| k | | | | | ■ | |
| j | | | | ■ | | |
| i | | | ■ | | | |
| h | | ■ | | | | |
| g | | | | | | |
| f | | | | | | |
| e | | | | | | |
| d | | ■ | | | | |
| c | | | ■ | | | |
| b | | | | ■ | | |
| a | | | | | ■ | |

FABRIC

RELATED APPLICATIONS

The present application is National Phase of International Application No. PCT/JP2022/016032 filed Mar. 30, 2022, and claims priority from Japanese Application No. 2021-058676, filed Mar. 30, 2021, the disclosure of which is hereby incorporated by reference herein in its entirety.

TECHNICAL FIELD

The present invention relates to a fabric having a knitted material into which a hollow fiber membrane is knitted as an insertion thread.

BACKGROUND ART

A technique has been disclosed that uses a hollow fiber membrane as a weft thread of a warp knitting machine in order to produce a hollow fiber membrane module used for muddy water filtration (Patent Literature 1). In this technique, the hollow fiber membrane forms the weft thread that forms the knitted material.

A technique of using a hollow fiber membrane for an article of clothing has been disclosed (Patent Literature 2). The technique of Patent Literature 2 is shown in FIG. 9. In this technique, a hollow fiber membrane 71 is attached to clothing 70, a pump 72 causes water to flow inside the hollow fiber membrane, and a cooling effect is obtained by the evaporation heat. Water is supplied from a water container 73 and the pump 72 is electrically operated. In this technique, sewing is a measure for attaching the hollow fiber membrane to the clothing. Since a needle is used to sew the hollow fiber membrane, there is a risk of damaging the hollow fiber membrane when the needle passes over the hollow fiber membrane or when the needle pierces the knitted material. In addition, when a plurality of hollow fiber membranes are arranged close to each other, the needle is likely to damage the hollow fiber membranes, making it difficult to attach the hollow fiber membranes through sewing.

Also, since the pump 72 is electrically operated as described above, a power source 74 and a switch 75 are necessary. However, from the viewpoint of comfort and design of clothing, it is preferable that there be no power source or switch.

A cable has been disclosed in which conductive wires are knitted onto a surface of a knitted fabric made of conductive fibers, and the cable is stretchable in both the warp and weft directions (Patent Literature 3). In this technique, in order to obtain uniformity in conduction, a plurality of conductive wires are arranged in a crossed or intertwined manner so that they compensate for each other when a conductive wire breaks. In order to be stretchable in the warp and weft directions, the conductive wires are knitted in a corrugated shape extending in the weft direction.

Contrarily, when hollow fiber membranes are knitted into a knitted fabric, they do not have to be arranged so as to cross or intertwine with each other like conductive wires. The hollow fiber membranes are rather required to be in contact with the knitted material over as large an area as possible in order to promote water absorption and diffusion from the hollow fiber membranes, resulting in a large gap between the hollow fiber membranes. Further, each hollow fiber membrane is required to be in sufficient contact with the knitted material. In this way, in the concept for knitting threads as an insertion thread, the problem to be solved is different between knitting conductive wires and knitting hollow fiber membranes. Therefore, the concept for knitting conductive wires cannot be directly applied to the concept for knitting hollow fiber membranes.

Water passes through the internal cavity of a hollow fiber membrane, and thereby the surroundings of the hollow fiber membrane can be cooled by the water itself or by the evaporation heat. Further, when a hollow fiber membrane is used for an article of clothing, micropores on the surface of the hollow fiber membrane absorb perspiration inward from the surface of the fiber, conduct and diffuse the perspiration in the hollow portion, and release the perspiration to the outside of the fiber. Taking away the evaporation heat from the wearer's body can cool the body. However, the micropores on the surface are easily damaged by rubbing or pulling, so that hollow fiber membrane is difficult to use as a thread forming a woven fabric or a knitted fabric. Therefore, there has been demand for development of a technique that utilizes a hollow fiber membrane in a fabric and, in turn, in clothing.

CITATION LIST

Patent Literature

Patent Literature 1: Japanese Patent Laid-Open No. 2009-235583

Patent Literature 2: Japanese Patent Laid-Open No. 2020-204131

Patent Literature 3: Japanese Patent Laid-Open No. 2016-92009

SUMMARY OF INVENTION

Technical Problem

A problem to be solved is to provide a fabric having a knitted material into which a hollow fiber membrane is knitted.

Another problem to be solved is to provide a configuration in which a liquid flows inside the hollow fiber membrane as one of forms of utilizing the fabric having the knitted material into which the hollow fiber membrane is knitted.

Still another problem to be solved is to provide a configuration that prevents a needle from penetrating into the hollow fiber membrane when the fabric having the knitted material into which the hollow fiber membrane is knitted is sewn on an article of clothing or when the fabrics each having the knitted material into which the hollow fiber membrane is knitted are sewn to produce an article of clothing.

Still another problem to be solved is to provide a configuration in which water coming out from the surface of the hollow fiber membrane knitted into the knitted material is easily absorbed and diffused.

Solution to Problem (1) The problem is solved with a fabric having a knitted material into which a hollow fiber membrane, serving as an insertion thread, is knitted.

(2) The problem is solved with the fabric according to (1), in which the hollow fiber membrane appears in a corrugated shape on one side of the knitted material.

(3) The problem is solved with the fabric according to (1), in which the hollow fiber membrane is laid in a double layer bag-like structure portion in the knitted material, the knitted material being composed of an upper material and a lower material, the knitted material being provided with a single layer structure portion and the double layer bag-like structure portion, the single layer structure portion being formed by the upper material and the lower material that are joined together, the double layer bag-like structure portion being formed by the upper material and the lower material that are separated from each other.

(4) The problem is solved with the fabric according to any of (1) to (3), in which the knitted material is warp-knitted and the hollow fiber membrane is knitted in a warp direction.

(5) The problem is solved with the fabric according to any of (1) to (4), comprising a pump for supplying a liquid to the hollow fiber membrane, in which the liquid flows inside the hollow fiber membrane.

(6) The problem is solved with the fabric according to (5), in which the liquid is water.

(7) The problem is solved with the fabric according to any of (1) to (6), in which the fabric is in a tape shape.

(8) The problem is solved with the fabric according to any of (1) to (7), in which the hollow fiber membrane includes an escape and is arranged on the knitted material, the escape being configured to avoid penetration of a needle into the hollow fiber membrane when the fabric is sewn.

(9) The problem is solved with the fabric according to any of (1) to (8), in which the knitted material has water absorption and quick drying properties.

The hollow fiber membrane is thus knitted into the knitted material as an insertion thread. This prevents rubbing or pulling that occurs when the hollow fiber membrane is knitted as a thread that forms the knitted material, so that damage is hardly caused on the surface of the hollow fiber membrane. Moreover, the hollow fiber membrane is used as an insertion thread, so that the amount of the hollow fiber membrane that is a material can be reduced.

In knitting the hollow fiber membrane, for example, the hollow fiber membrane is arranged on the surface of the knitted material so as to form a corrugated shape, and the knitted material is made of a stretchable material, resulting in a stretchable fabric.

When the fabric, which has the hollow fiber membrane appearing on one side of the knitted material, is attached to a product, the surface on which the hollow fiber membrane appears can face the side that is in contact with the product. As a result, the hollow fiber membrane is sandwiched between the object to which the fabric is attached and the knitted material, so that the hollow fiber membrane does not come into contact with the outside. The result is that damage to the hollow fiber membrane can be avoided.

A technique is known in which a knitted material is composed of an upper material and a lower material, and the upper material and the lower material are joined together to form a single layer structure. In knitting such a knitted material, the hollow fiber membrane is knitted as an insertion thread. When the hollow fiber membrane is knitted as an insertion thread, the knitting position is not shifted in the weft thread direction but kept at the same position. As a result, the upper material and the lower material are not joined together to form a double layer bag-like structure, and the hollow fiber membrane can be wrapped in the double layer bag-like structure. The hollow fiber membrane is thus wrapped in a double layer bag-like structure of the fabric, allowing the hollow fiber membrane to come into contact with the knitted material and to avoid contact with the outside so that the membrane is not damaged by rubbing.

A tubular cavity inside the hollow fiber membrane allows a liquid to flow through this cavity. For example, if a fabric into which a hollow fiber membrane is knitted is applied to an article of clothing, the following is assumed. The liquid containing perfume allows utilizing the scent of perfume emanating from the fabric. Alternatively, the liquid having an insect-repellent odor allows obtaining an insect-repellent effect. The liquid having a medical effect allows obtaining a medical effect. When the fabric into which a hollow fiber membrane is knitted is attached to an article of clothing, the fabric can be attached at a position where a medical effect can be obtained.

Using water as the liquid allows the surroundings to be cooled by the water itself or by the evaporation heat.

As the hollow fiber membrane occupies more surface area of the knitted material, the water absorbing and diffusing effect of the hollow fiber membrane increases. Therefore, the knitted material is desirably in contact with the hollow fiber membrane over as large an area as possible. Therefore, for example, the hollow fiber membrane may be arranged so as to draw a corrugated shape. The direction of the hollow fiber membrane is greatly changed at the position corresponding to the apex of the corrugated shape. Therefore, the angle of the direction change is determined in consideration of the minimum bending radius of the hollow fiber membrane.

When water flows inside the hollow fiber membrane, the water oozes out from micropores on the surface of the hollow fiber membrane. The knitted material is maintained with water stored, and thereby the surroundings can be continuously cooled. Therefore, it is preferable that the surroundings of the hollow fiber membrane have high water absorption and water diffusibility. Such properties may be achieved by the knitted material itself made of a material with such properties through a known technique. Alternatively, such properties may be provided later through a known technique.

DESCRIPTION OF EMBODIMENTS

Preferred embodiments of the present invention will be described below with reference to drawings. Examples 1 and 2 are examples in which a knitted material is formed by warp knitting, and a hollow fiber membrane is knitted as an insertion thread in parallel with the formation of the knitted material. Example 1 is an example in which a hollow fiber membrane appears in a corrugated shape on one side of the knitted material, and Example 2 is an example in which a hollow fiber membrane extends while being wrapped in a double layer bag-like structure portion. Example 3 is an example in which water is allowed to flow inside a hollow fiber membrane knitted into a knitted material. Example 4 is an example in which a fabric into which hollow fiber membranes are knitted is made into a tape shape and is attached to an article of clothing for use. Example 5 is an example in which escapes are provided so that a needle does not penetrate into the hollow fiber membranes when a fabric into which hollow fiber membranes are knitted is sewn to be attached to a product.

Example 1

Figure 1:
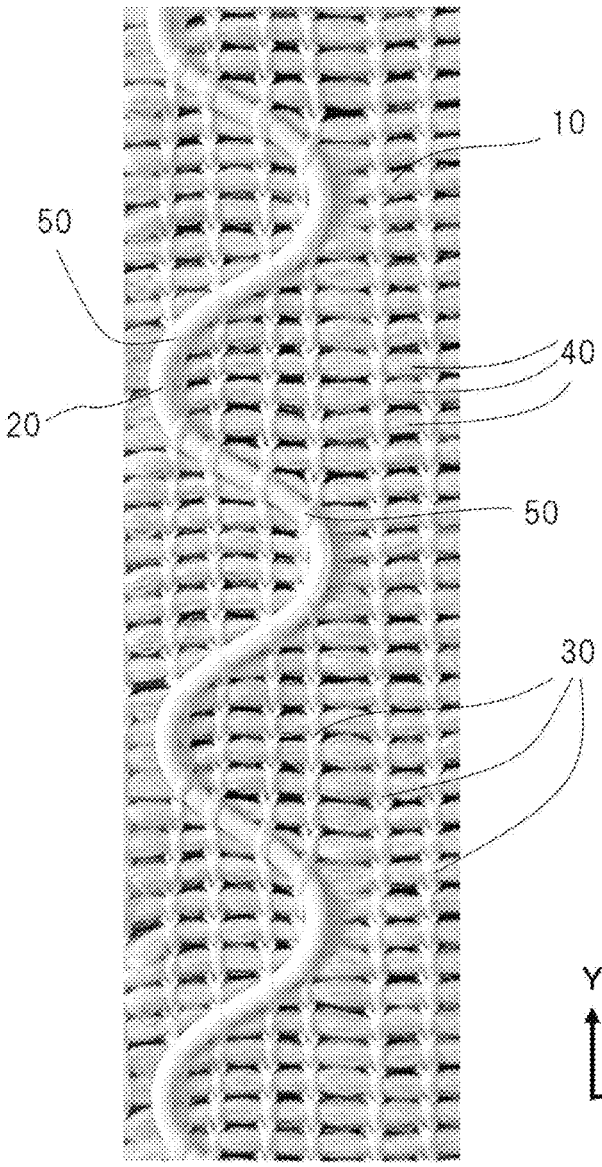
FIG. 1 FIGS. 1(*a*) to 1(*b*) show Example 1.

Example 1 is shown in FIGS. 1(*a*) and 1(*b*). As shown in FIG. 1(*a*), in Example 1, a knitted material 10 is formed by warp knitting, and in parallel with the formation of the knitted material 10, a hollow fiber membrane 20 is knitted as an insertion thread inserted in the longitudinal direction.

In warp knitting, warp threads 30 extending in a Y-axis direction is intertwined and fixed with weft threads 40 extending in an X-axis direction to form stitches. The work in which the warp threads 30 is intertwined and fixed with one weft thread 40 successively advances in the X-axis direction, and then the work turns back when the intertwining and fixing has been performed up to the end of the weft thread 40, to sequentially form similar stitches on a different weft thread 40 adjacent in the Y-axis direction.

The method of knitting the hollow fiber membrane 20 is as follows. When the warp threads are intertwined and fixed with the weft threads to form the knitted material, the warp threads are intertwined and fixed with the hollow fiber membrane together with the weft threads to be intertwined and fixed. The threads seen at the parts indicated by reference numerals 50 in FIG. 1(*a*) (the hollow fiber membrane stopper 50) are the warp threads each intertwined and fixed with the hollow fiber membrane and the weft thread together.

In Example 1, the hollow fiber membrane is arranged so as to form a corrugated shape on the knitted material. Therefore, the hollow fiber membrane stopper 50 is changed in position in a predetermined cycle. This will be described with reference to FIG. 1(*b*). FIG. 1(*b*) shows one stitch by a square space, and the black space is a position where the hollow fiber membrane is intertwined and fixed.

When the knitted material is formed, stitches are made in the order of 6*a* to 1*a*, 1*b* to 6*b*, 6*c* to 1*c*, (an omission of middle parts), 6*m* to 1*m*, 1*n* to 6*n*, and 6*o* to 1*o*. In other words, the warp threads 30 are intertwined and fixed with the weft threads 40 one by one in this order. When stitches 6*a* to 1*a* are made, at the position 5*a*, a warp thread overlaps, and is intertwined and fixed with the hollow fiber membrane 50 together with the weft thread to be intertwined and fixed. When stitches 1*b* to 6*b* are formed, a warp thread is intertwined and fixed with the hollow fiber membrane at 4*b*, which is shifted by one in the negative direction of the X axis. Thereafter, a warp thread is intertwined and fixed with the hollow fiber membrane at the position 3*c* when stitches 6*c* to 1*c* are made, and at position 2*d* when stitches 1*d* to 6*d* are made. When stitches 6*e* to 1*e*, if to 6*f*, and 6*g* to 1*g* are made, the warp threads are not intertwined and fixed with the hollow fiber membrane. When stitches of 1*h* to 6*h* are made, a warp thread is intertwined and fixed with the hollow fiber membrane at the position 2*h*. Thereafter, a warp thread is intertwined and fixed with the hollow fiber membrane at the position 3*i* when stitches 6*i* to 1*i* are made, at the position 4*j* when stitches 1*j* to 6*j* are made, and at the position 5*k* when stitches 6*k* to 1*k* are made. When stitches 1*l* to 6*l*, 6*m* to 1*m*, and in to 6*n* are made, the warp threads are not intertwined and fixed with the hollow fiber membrane. Up to this point, the one cycle is formed. Thereafter, this cycle is repeated.

Knitting as described above arranges the hollow fiber membranes in a corrugated shape on one side of the knitted material as shown in FIG. 1(*a*). The warp threads of the knitted material overlap, and are intertwined and fixed with weft threads, so that the hollow fiber membrane is in tight contact with the knitted material. Therefore, the liquid oozing out from the micropores on the surface of the hollow fiber membrane efficiently permeates into the knitted material. Further, adjustment of the tension of the warp threads can prevent the hollow from collapsing according to the properties of the hollow fiber membrane. The apex angle of the corrugated shape can be determined according to the properties of the hollow fiber membrane to be knitted and fixed, and the positions where the hollow fiber membrane is knitted and fixed can be determined so that the membrane is arranged at such an angle.

The outer diameter, the inner diameter and the like of the hollow fiber membrane are determined from the viewpoints of having a large flow rate of water when water flows through it and having strength that does not cause problems in use. The small thickness makes knitting easily but reduces the amount of water. Also, increase in the water permeability through the micropores reduces the strength. A hollow fiber membrane suitable for use is, for example, as follows:

Outer diameter: 504 μm
Inner diameter: 264 μm
Water permeability: 155 L/($m^2$·bar·hr)
Breaking load: 2.5 N
Breaking strength: 17.6 MPa
Breaking elongation: 180%

Example 2

Figure 2:
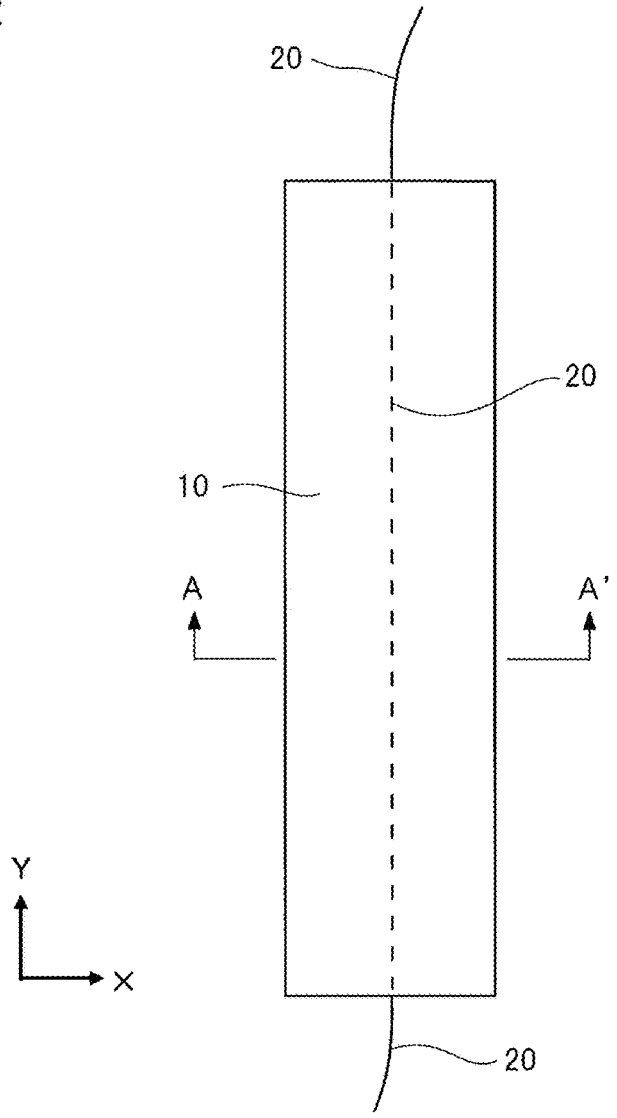
FIG. 2 shows Example 2.
Figure 3:
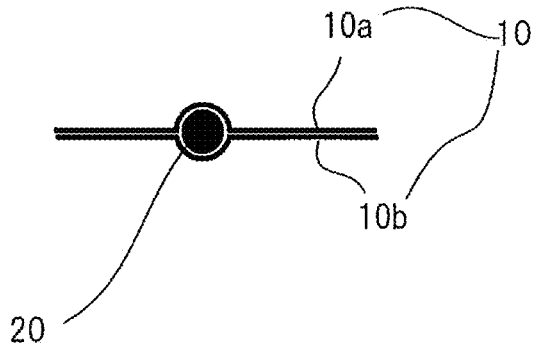
FIG. 3 shows Example 2.

FIG. 2 shows Example 2. In Example 2, the knitted material 10 is knitted by warp knitting, and in parallel with the formation of the knitted material 10, the hollow fiber membrane 20 is knitted as an insertion thread to be inserted in the longitudinal direction. FIG. 3 is a cross-sectional view taken along a line A-A' of FIG. 2. As shown in FIG. 3, the knitted material 10 is composed of an upper material 10*a* and a lower material 10*b*, and the hollow fiber membrane 20 extends in a bag-like space formed by the upper material and the lower material that are not joined. In parts other than the bag-like space, the upper material and the lower material are knitted and fixed to be joined together. The dotted line in FIG. 2 indicates that there is a bag-like space formed by the upper material and the lower material that are not joined, and there is the hollow fiber membrane in the bag-like space.

The knitting method of the hollow fiber membrane in Example 2 is as follows. In Example 2, the weft threads are doubled with the weft threads forming the front side and the weft threads forming the back side. A hollow fiber membrane is knitted as an insertion thread that are inserted in the warp direction. The insertion thread is intertwined and fixed with the warp threads. In Example 2, the position where the insertion thread is intertwined and fixed is not shifted in the X-axis direction, the insertion thread is intertwined and fixed at the same position in the X-axis direction over the entire area, and the knitting proceeds in the Y-direction. This knitting method is a known knitting method. The following describes the arrangement, etc. of the threads at the position where the insertion threads are intertwined and fixed. First, a weft thread to be the back side is pulled in the weft direction, and then the insertion thread is pulled to the front side thereof in the warp direction and is prepared at the insertion position. Next, a weft thread to be the front side is pulled in the weft direction. At this stage, there are threads in the order of the back weft thread, the insertion thread, and the front weft thread; and then the warp threads are knitted so as to bind the above threads. In this way, the insertion thread to be knitted in the warp direction are knitted without touching the warp threads.

As a result, the part of the knitted material where the hollow fiber membrane is intertwined and fixed becomes a space, and the hollow fiber membrane is contained in this space.

Example 3

Figure 4:
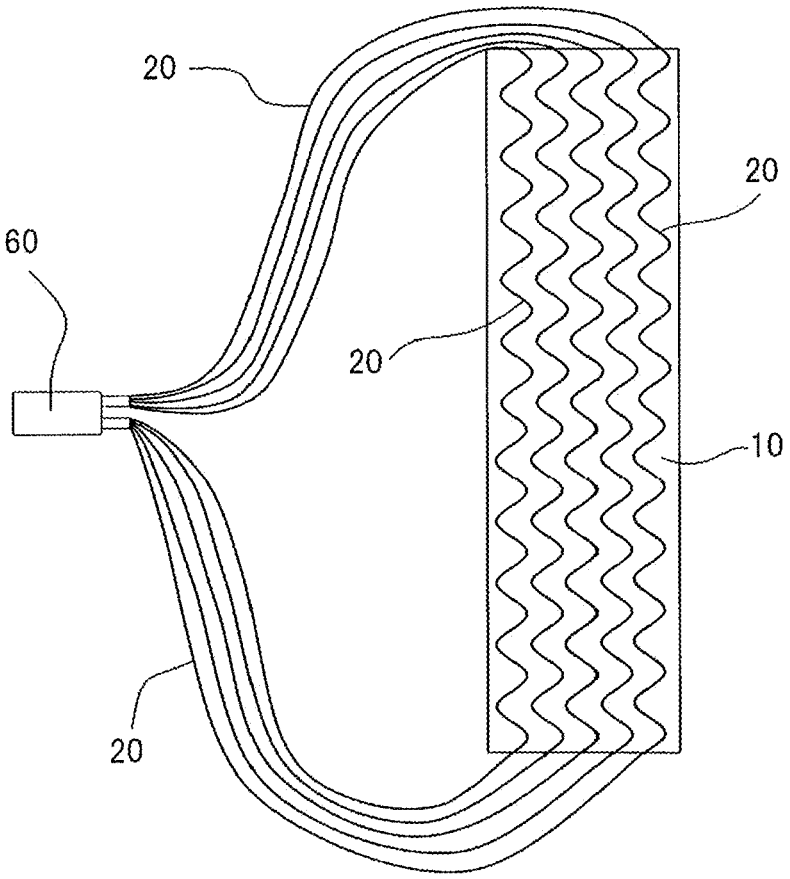
FIG. 4 shows Example 3.

In Example 3, the following describes an example in which water is allowed to flow inside the hollow fiber membranes knitted into the knitted material. As shown in FIG. 4, both open ends of each hollow fiber membrane 20 are connected to the pump 60. The pump 60 is made of an elastic body and can pump out water by pushing it by fingers. The water to be used is tap water.

The pump is a manual type that is pushed by fingers, so no power source or switch is required. Since no power source or switch is required, it is convenient to attach this fabric to a product and use it. In addition, manual type pump allows freely adjusting the flow rate of water. The preferred flow rate varies depending on the air temperature, humidity, water permeability of the hollow fiber membrane, etc. However, if this fabric is used for an article of clothing, for example, the wearer can manually adjust the flow rate.

When the amount of water decreases due to evaporation, the cover of the pump can be opened to replenish or replace the water inside. To prevent water putrefaction, it is preferable that tap water have a sterilizing and deodorizing function.

Figure 5:
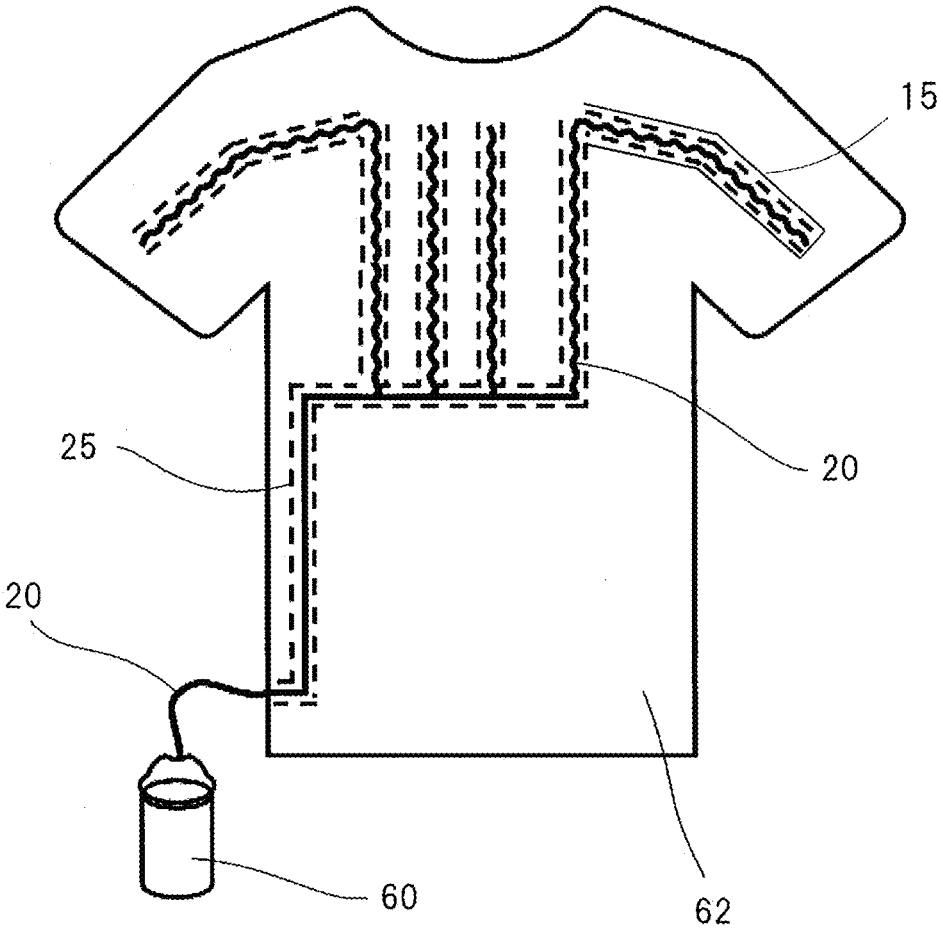
FIG. 5 shows Example 3 and Example 4.
Figure 6A:
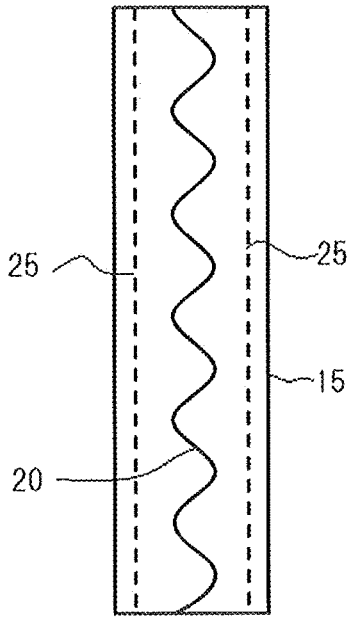
FIG. 6 FIGS. 6(*a*) to 6(*d*) show Example 4.
Figure 6B:
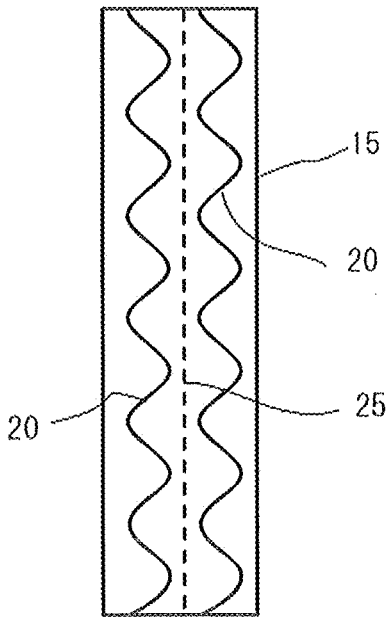
Figure 6C:
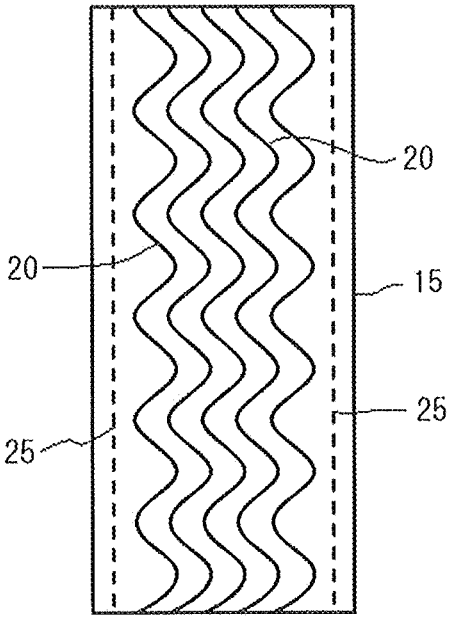
Figure 6D:
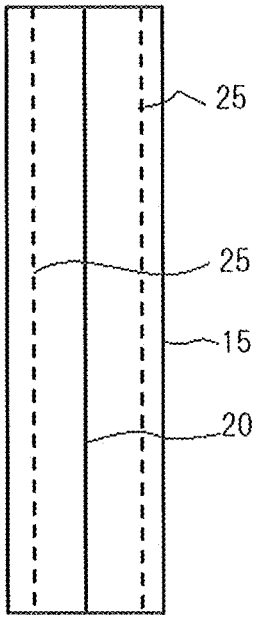

There can be a configuration in which the water flowing inside the hollow fiber membrane does not circulate. An example of the configuration without circulation is shown in FIG. 5. In this case, only one end of the hollow fiber membrane is connected to the pump 60 and the other end is open. Most of the water flowing inside disappears by evaporation before reaching the other end.

Example 4

In Example 4, a fabric in a tape shape into which the hollow fiber membrane is knitted is attached to an article of clothing. The "tape shape" means a narrow and long shape. The method of knitting the hollow fiber membranes, the number of hollow fiber membranes, and the material of the knitted material are selected depending on the location where the fabrics are attached.

The tape-shaped fabric is attached, by sewing or pasting it, to a part of an article of clothing that is desired to be cooled. From the viewpoint of attachment to an article of clothing, the width of the tape is easy to handle if it is, for example, about 1 cm to 2 cm.

As shown in FIG. 5, tape-shaped fabrics 15 are sewn onto an article of clothing 62. The tape-shaped fabric 15 has a hollow fiber membrane 20 knitted therein. A reference numeral 25 denotes a seam. One end of the hollow fiber membrane 20 is connected to the pump 60. FIGS. 6(*a*) to 6(*d*) illustrate relationships of arrangements of the hollow fiber membranes 20 and seams 25. In FIG. 6(*a*), FIG. 6(*b*) and FIG. 6(*c*), the hollow fiber membranes are knitted in a corrugated shape, and the tape-shaped fabric is stretchable in the longitudinal direction. They are suitable for attaching to parts that need to be stretchable. In this case, the knitted material is made of a stretchable thread. In FIG. 6(*d*), the hollow fiber membrane extends linearly and is not stretchable in the longitudinal direction.

As shown in FIG. 6(*a*) to FIG. 6(*d*), depending on the position of the hollow fiber membranes 20 knitted into the tape-shaped fabrics 15, the fabrics 15 are each sewn to the object at a point where the needle does not pass over the hollow fiber membranes 20.

In Example 4, the object to which the tape-shaped fabric is attached is an article of clothing, but the object to which it is attached is not limited to clothing. For cooling purposes, the tape-shaped fabrics can be used for furniture, car seats, exterior walls, and roofs of buildings. In addition, for the purposes of humidification, the tape-shaped fabrics can be used for indoor curtains and partitions.

The tape-shaped fabrics can also be used in various ways depending on the liquids that flow inside the hollow fiber membrane, and can be attached to products accordingly. For insect repellent purposes, the tape-shaped fabrics can be used in tents in addition to clothing. In addition, for the purpose of sterilization, the tape-shaped fabrics can be used for indoor curtains and partitions in addition to clothing.

Example 5

In Example 5, description is made on an example of providing "escapes" so that the needle does not penetrate into the hollow fiber membrane in sewing the fabric into which the hollow fiber membrane is knitted.

The fabric into which the hollow fiber membrane is knitted goes through a sewing process when the fabric is used for a product. Also when the fabric into which the hollow fiber membrane is knitted is made into a tape shape and is sewn into a product, the fabric goes through a sewing process. Since water flows inside the hollow fiber membranes, it is necessary to avoid needles penetrating into the hollow fiber membranes in sewing. The part through which the needle passes in sewing is unknown when the fabric into which the hollow fiber membrane is knitted is produced. Therefore, it is necessary to be able to avoid penetration of the needle into the hollow fiber membrane regardless of which part is to be sewn.

Figure 7:
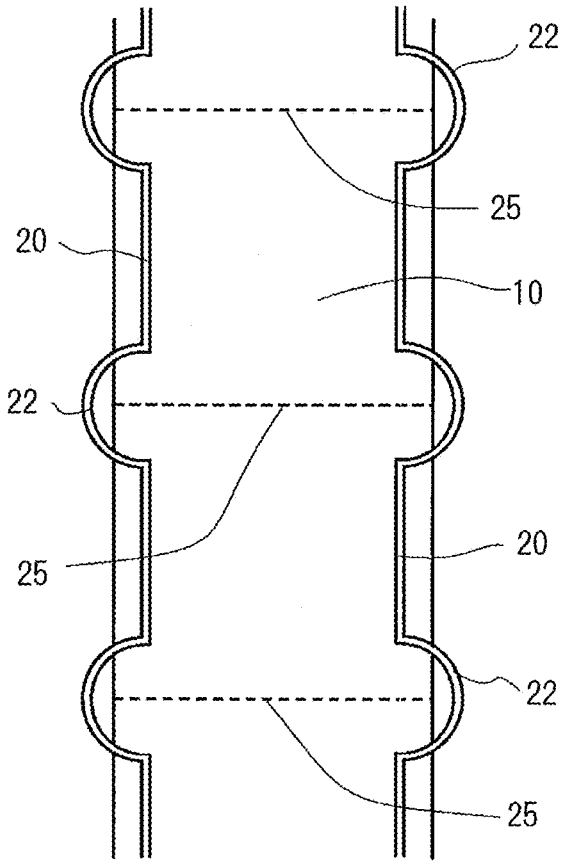
FIG. 7 shows Example 5.
Figure 8:
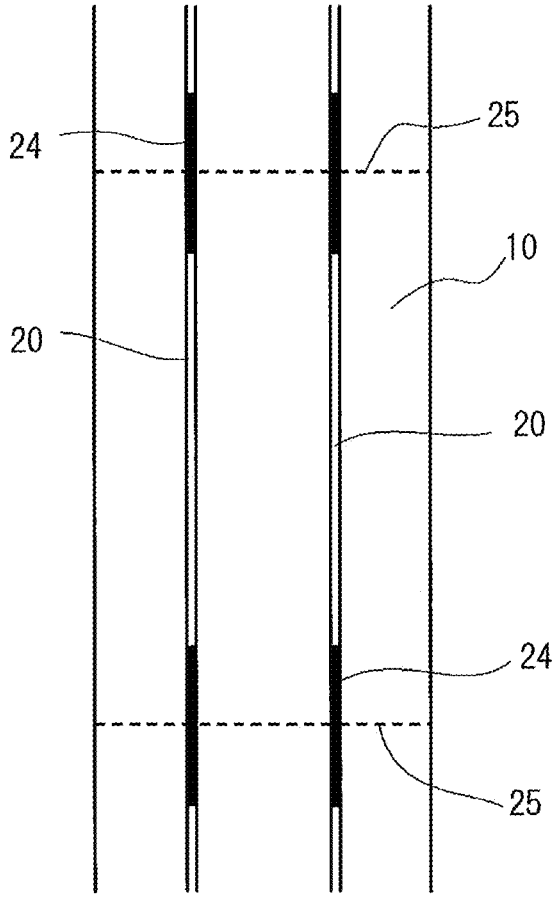
FIG. 8 shows Example 5.
Figure 9:
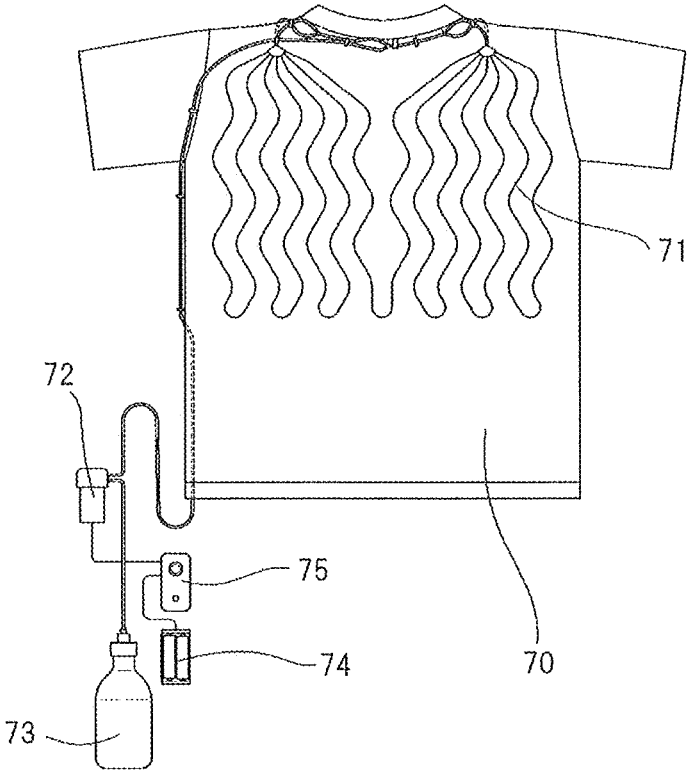
FIG. 9 Prior Art
FIG. 9 shows a conventional example.

FIGS. 7 and 8 are examples of "escapes" in the case of a tape-shaped fabric with hollow fiber membranes knitted on the surface. In FIG. 7, the hollow fiber membranes 20 are provided with loops 22 in relation to the knitted material 10, and the membranes 20 are not knitted into the knitted material 10 at the positions of the loops 22. In sewing, positions are sewn that are indicated by the seams 25, in other words, that have no hollow fiber membranes knitted into the knitted material 10. Each of the loops 22 corresponds to an "escape" (escape A). In FIG. 8, the hollow fiber membrane has positions indicated by reference numerals 24 where the membranes are not knitted into the knitted material 10, but the membranes are not looped. Each of the non-knitting positions 24 corresponds to an "escape" (escape B). In sewing, the positions of the seams 25 are sewn while the hollow fiber membranes at the positions 24 are lifted up for avoidance.

REFERENCE SIGNS LIST

10 knitted material
10*a* upper material
10*b* lower material
15 tape-shaped fabric
20 hollow fiber membrane
22 escape A

24 escape B
25 seam
30 warp thread
40 weft thread
50 hollow fiber membrane stopper
60 pump
62 clothing
70 clothing
71 hollow fiber membrane
72 pump
73 water container
74 power source
75 switch

The invention claimed is:

1. A knitted material comprising:

a hollow fiber having a tube wall with micropores;

a single layer structure portion composed of a first layer and a second layer overlapped and joined together; and a double layer bag structure portion formed of the first layer and the second layer that are separated and spaced apart from each other, wherein the hollow fiber is located as an insertion thread in the double layer bag structure portion so that the knitted material is configured to allow water as a liquid to flow through the hollow fiber and permeate from the micropores.

2. The knitted material according to claim 1, wherein each of the first layer and the second layer is warp-knitted.

3. A combination of the knitted material and a liquid, comprising the knitted material according to claim 1, and the liquid permeated from the micropores of the hollow fiber.

4. The combination according to claim 3, wherein the liquid contains perfume, or an insect-repellent odor.

5. The knitted material according to claim 1, wherein the first layer and the second layer overlapped are knitted together in the single layer structure portion, and the hollow fiber is located in the double layer bag structure portion where the first layer and the second layer are not knitted.

6. The knitted material according to claim 1, wherein the first layer and the second layer are joined with each other by knitting in the single layer structure portion, leaving a bag space where the first layer and the second layer are not joined in the double layer bag structure portion.

7. The knitted material according to claim 1, wherein the knitted material contains a space formed by the hollow fiber intertwined and fixed with warp threads.

8. The knitted material according to claim 1, wherein the first layer and the second layer include weft threads, respectively, the weft threads forming the first layer and the weft threads forming the second layer are joined together by warp threads in the single layer structure portion, the weft threads forming the first layer and the weft threads forming the second layer are not joined in the double layer structure portion, and the hollow fiber is located in the double layer bag structure portion between the weft threads forming the first layer and the weft threads forming the second layer.

* * * * *